United States Patent [19]

Checkland et al.

[11] Patent Number: 4,562,302

[45] Date of Patent: Dec. 31, 1985

[54] INSIDE TELECOMMUNICATION CABLE

[75] Inventors: John A. Checkland; Leo V. Woytiuk, both of Pointe Claire, Canada

[73] Assignee: Northern Telecom Limited, Montreal, Canada

[21] Appl. No.: 451,944

[22] Filed: Dec. 21, 1982

Related U.S. Application Data

[63] Continuation-in-part of Ser. No. 309,252, Oct. 5, 1981, abandoned.

[51] Int. Cl.[4] ..... H01B 7/00

[52] U.S. Cl. ..... 174/118; 174/102 P; 174/110 V; 174/121 A

[58] Field of Search ..... 174/102 P, 110 V, 116, 174/118, 121 A

[56] References Cited

U.S. PATENT DOCUMENTS

| | | | |
|---|---|---|---|
| 3,803,339 | 4/1974 | Speekman | 174/116 X |
| 3,843,831 | 1/1974 | Hutchison et al. | 174/116 |
| 4,004,077 | 1/1977 | Woytiuk | 174/116 X |
| 4,018,983 | 4/1977 | Pedlow | 174/121 A X |
| 4,238,638 | 12/1980 | Cretney | 174/23 C |
| 4,401,845 | 8/1983 | Odhner | 174/121 A X |
| 4,419,157 | 12/1983 | Ferrentino | 174/102 P X |

FOREIGN PATENT DOCUMENTS

| | | | |
|---|---|---|---|
| 2397 | 6/1979 | European Pat. Off. | 174/121 A |
| 55-4837 | 1/1980 | Japan | 174/116 |
| 1175850 | 12/1969 | United Kingdom | 174/116 |
| 1418027 | 12/1975 | United Kingdom | 174/110 V |

*Primary Examiner*—R. R. Kucia

*Attorney, Agent, or Firm*—R. J. Austin

[57] ABSTRACT

An inside cable having a core of conductors with conductor insulation formed from polyvinylchloride and in which interstices between conductors contains a fire resistant powder to resist burning of the core. The core is surrounded by a fire resistant jacket and the cable is devoid of a tubular metal shield or sheath surrounding the core.

4 Claims, No Drawings

INSIDE TELECOMMUNICATION CABLE

This application is a continuation-in-part of application Ser. No. 309,252, filed Oct. 5, 1981 now abandoned.

This invention relates to fire-retardant inside cable.

A fire-retardant inside cable is one which is designed for use inside buildings as distinct from the open air or beneath the ground. Such cable includes power cable, central office cable, station cable, signal cable, service entrance cable, switchboard cable, and telecommunications cable. Inside cable has a requirement which does not apply to buried cable and this is that it needs to have outstanding fire resistant properties to prevent the cable from spreading fire through a building.

Some cable, such as telecommunications cable, is installed in return air plenums for air conditioning systems. In the event of a cable burning in such a location where, due to high air flow, oxygen levels are considerably higher than in ambient conditions, unless fire resistant precautions are taken the eventual fire spread may have disastrous consequences. To provide fire resistance, building codes have required conventional inside cables to be installed within metal conduits. These conduits are supposed to separate the cable from the fire and starve the cable of oxygen during pyrolysis, whereby the distance of burning along the cable is restricted. Burning restriction is also important because it limits the amount of smoke which is generated. Frequently, lives are lost, not because of the heat of the fire, but as a direct result of the smoke issuing from a burning cable and delivered through the plenum system into rooms, stairways and elevator shafts. This smoke is both toxic and capable of being light impenetrable, whereby persons may lose their direction in a burning building. There are, however, two major problems with this accepted cable construction. One is excessive cost of production and the other is the inflexibility of the structure which inhibits ease of installation. One way of increasing the fire resistance and decreasing the smoke output of a cable for inside use is to employ a jacketing material, which is itself fire resistant. Thus where a cable for outside or underground use may include a jacket formed from polyethylene, it is essential that a material of greater fire resistance is used for inside cable such as one having a polyvinylchloride composition. A problem with a jacket of such a composition is, however, that in spite of the endothermic nature of the decomposition of the resin, the jacketing material is not completely fire proof. One reason for this is the use of plasticizer in the jacketing composition which is required to render the polyvinylchloride resin flexible. Also, an inside cable needs conductor insulating materials which are made from or include fire resistant material. However, while fire resistancy is a requirement for both the jacket and conductor insulation materials, nevertheless a certain amount of burning of these materials may take place and this assists in the fire spread and in the smoke generation.

It would be an advantage to provide an inside cable and method for making it in which the fire resistance is increased beyond that, and thus smoke generation is decreased below that, found in use of a conventional cable with polyvinylchloride conductor insulation and which could thus be installed in air plenums without conduit.

According to the present invention, there is provided an inside cable devoid of a surrounding metal conduit and comprising a plurality of insulated electrical conductors forming a core and in which the insulation is formed from a compound based upon plasticised polyvinylchloride; the core surrounded by a jacket and devoid of a tubular, core surrounding, metal shield or sheath, and the interstices between conductors in the core containing a fire resistant powder which resists the burning of the core.

Because of the formation of cyclic light obscuring species, the smoke emission of plasticised polyvinchloride may be many times greater than the smoke emitted by polyethylene. The presence of the powder resists the burning of the insulation on the conductors thereby lessening the smoke emission.

Preferably the core is filled as far as is practical with the powder. For this purpose, any hydrated materials in powder form will suffice.

The powder is any material which will release water of hydration and by this means resists burning.

It is preferably alumina trihydrate, i.e. $2Al(OH)_3$. Alternatively, the fire resistant powder consists of any of the following, namely, magnesium silicon hydrate, hydrated zinc borate or calcium sulphate. Mixtures of any of the above powders or mixtures of any of the powders with other suitable powders will also suffice.

It is recognized that when a polyvinylchloride insulated and jacketed inside cable burns, then any plasticiser in the jacket material assists in flame spread as measured by the distance flames spread from the point of application of a heat source to the jacket. One reason for this is that the plasticiser volatolises upon being heated and catches fire very easily. The reason for the powder assisting in burn resistance is due to a combination of factors. It is considered that fire resistant powder in general acts to insulate the core from the jacket during pyrolysis.

Further to this, it is felt that the resistant powder transfers the heat from the initially localized burning area into the powder, whereby the heat available for promoting flame spread along the jacket is dissipated. A further reason is that the location of the powder within the jacket displaces oxygen which would be otherwise available for the promotion of combustion and hence it is extremely difficult for the flame spread to occur down the inside of the jacket. The immediate location of the powder also means that the insulated conductors on the outside of the core have a covering of powder and this increases the difficulty for flame to spread from the jacket onto the insulation of the conductors themselves. There is the added advantage, of course, that the smoke output is reduced substantially when the extent of burning is minimized by the presence of the powder which also effectively douses the flame.

When a hydrated powder is used, it is felt that its presence causes a cooling action upon the burning area as the heat releases the water of hydration which also acts directly to douse the flames.

In inside cable constructions with fire resistant properties accompanied by minimal flame propogation and smoke emission characteristics, the jacket is made from a fluorinated polymeric material and the core is substantially filled with the fire resistant powder. The fluorinated polymeric material of the jacket minimizes flame spread to a more localized area than is possible with other materials, e.g. polyvinylchloride compositions which by their nature require plasticiser which burns easily. However, if polyvinylchloride is used as a jacketing material, while no improvement may be obtained in the flame spread along the jacket, the use of the powder in the core significantly reduces the smoke output. This indicates that with the use of the powder, there is a reduction in burning of the core.

The present invention also includes a method of manufacturing an inside cable, this method comprising: providing a core of polyvinylchloride composition insulated electrical conductors, in which the insulation is fire resistant and smoke producing during combustion, placing a fire resistant powder within interstices formed between the conductors and providing a jacket around the core in which the jacket is formed from a fire resistant material, while avoiding the provision of a tubular metal shield or sheath between the core and the jacket.

Embodiments of the present invention will now be described, by way of example, with reference to the accompanying drawing which is a cross-sectional view through a cable forming one of the embodiments.

In a prototype inside telecommunications cable 10, as shown in FIG. 1, a core 12 is formed from twenty-five pairs of 24 AWG electrical conductors, 14, insulated with a polyvinylchloride composition and which have been twisted together and bound with a binding tape (not shown) in conventional manner. The insulation may be of any desired thickness, but in this case is around 6 mil. The insulation composition is a standard composition for conductors and is as shown in Composition I below:

| Composition I | Parts by Wt. |
|---|---|
| Polyvinylchloride Resin | 100.00 |
| Plasticiser | 36.00 |
| Calcium Carbonate Filler | 25.00 |
| Stabilizer and Flame Retardant Filler | 11.00 |
| Total | 172.00 |

Surrounding the core 12 is an aromatic polyamide tape core wrap (not shown) of any suitable thickness which also contributes as a flame barrier. In this case, the thickness is about 5 mil, but may be less on cores with less conductor pairs. For instance, the thickness may be about 3 mil on cores with three or four conductor pair. The core wrap may be spirally formed around the core or, as in this example, is applied longitudinally to be wrapped around with an axially extending overlap for the core wrap ends. Around the core wrap is a jacket 15 of extruded polymeric material which is, in fact, of polyvinylchloride composition. The jacket wall thickness is nominally 20 mil. The jacket composition is as standard composition for jacket material and is as follows in Composition II.

| Composition II | Parts by Wt. |
|---|---|
| Polyvinylchloride Resin | 100.00 |
| Plasticiser | 40.00 |
| Calcium Carbonate Filler | 35.00 |
| Stabilizer and Antioxidant | 12.00 |
| Total | 187.00 |

The cable core has interstices between the insulated conductors filled with a fire resistant powder which in this case is 100% calcium carbonate powder of 0.3 micron size.

A sample of the cable according to the embodiment (designated "B" in the following table) was tested for flame spread conditions by causing a localized area of the cable to commence burning at a temperature of around 550° C.

The test was conducted by Underwriters Laboratories personnel in a Steiner Tunnel under the normal flame spread and smoke rating test conditions according to the test standards of Underwriters Laboratories, which were subsequently written on and formalized under the designation UL 910. This new test, UL 910, is used in classifying cables for their suitability for use as plenum cables. Test UL 910 is now a standard for determining fire spread and smoke density characteristics of cables in air handling spaces and was first published on Apr. 30, 1982 in final form. The test conditions used by Underwriters Laboratories before use of the new test UL 910, will be referred to herein as the "prior test conditions".

The flame spread and smoke density characteristics of sample "B" were compared with a sample of the same cable structure having the above compositions I and II for the insulation and jacket and in which no flame resistant powder was used. This latter sample is designated "A" in the following Table I. Then a comparison was made with a further embodiment of the same cable structure, but in which the powder used was 100% alumina trihydrate ("C" in the table). A further comparison was made with another embodiment (sample "D") that is a cable using 100% alumina trihydrate powder in the core and with a jacket of a vinylidene fluoride polymer composition. The nominal wall thickness of this jacket was also 20 mil. In this sample "D", the conductor insulation was of a lower burn and lower smoke emission composition as shown by Composition III below:

| Composition III | Parts by Wt. |
|---|---|
| Polyvinylchloride Resin | 100.00 |
| Plasticiser | 28.00 |
| Stabilizer and Antioxidant | 13.00 |
| *Antimony Trioxide and Zinc Borate | 8.00 |
| Calcium Carbonate | 25.00 |
| Internal Lubricant | 1.50 |
| | 175.50 |

*In composition III, these materials are fire retardants.

Composition III has less flame spread and smoke output than Composition II. In the above tests as shown by Table I, flame spread is the maximum distance flame was seen to extend beyond the point of application of a burner flame to each sample. Smoke density was measured at a vent pipe from the test chamber of the Steiner Tunnel by light absorption techniques using a photoelectric cell connected to a recording device that processes the obtained signal into a continuous record of smoke. The smoke density is given by the following formula:

$$\text{Smoke density} = \log_{10} = \frac{T_o}{T}$$

in which:

To is the initial light transmission without smoke; and

T. is the light transmission during the test; this varies with amount of smoke.

Both average and peak smoke densities were reported. Table I shows the peak smoke density for each test:

TABLE 1

| Cable Structure | Flame Spread (ft.) | Peak Smoke Density |
|---|---|---|
| A. Cable Devoid of Powder | 14 | 3.5 |
| B. Cable and Calcium Carbonate Powder | 14 | 1.75 |
| C. Cable and Alumina Trihydrate Powder | 14 | 1.00 |
| D. Cable and Vinylidene Fluoride Polymer Jacket (+C.) | 4 | 0.75 |

As may be seen from the above test results, in cable A which was devoid of powder in the interstices between conductors, the flame spread along the jacket from the point of heat application was 14 feet. This was accompanied by a smoke density reading of 3.5.

Cable B having exactly the same structure as A, but with the addition of calcium carbonate powder had substantially the same flame spread along the jacket as cable A. The flame spread is dominated by the flame spread characteristics of the jacket. It is significant, however, that the smoke density reading of 1.75 for cable B is half that for cable A, thus indicating that the presence of the powder cut down substantially on the smoke emissions. Obviously, this was because the powder reduced burning of the insulation of the core conductors. Cable C also had a flame spread of 14 feet, but the smoke emissions were further reduced as is shown by the smoke density reding of 1.00, thus showing that alumina trihydrate was more effective in reducing burning of the core than calcium carbonate powder.

Cable D is significantly superior to cables A, B and C, not only because it further reduced the smoke emissions, but also because it reduced, in impressive fashion, the flame spread distance along the jacket to 4 feet.

The above tests show that when a fire resistant powder is used to fill the interstices in inside cable and without use of a tubular metallic shield or sheath between core and jacket, then immediately, a significant drop in smoke emissions results, thereby decreasing the possibility of fatalities being caused through smoke content in a fire even though the actual flame spread along the jacket may not be noticeably reduced. In any cable structure which is taken, the actual reduction in smoke emissions is dependent upon the type of powder used. In addition, the material of jacket may also increase fire resistance as is clear when a vinylidene fluoride polymer jacket was used in cable D, thus leading to flame spread reduction.

In the above samples B to D tested, oxygen avaiable to promote combustion is reduced by the replacement of oxygen by the powder within the interstices of the core thus reducing burning of the conductor insulation. The powder may also extract heat from the plasticiser when using a polyvinylchloride composition in the jacket material, thereby tending to help in fire retardation of the jacket. It should be borne in mind that the fire resistance and reduced smoke emission characteristics of inside cable according to the invention as shown by the embodiments, were obtained while the cable had a flexibility befitting it for inside use. Extreme flexibility is required for ease of installation where sudden directional changes and small radii turns are required and the avoidance of tubular metallic shields or sheaths is invaluable in this regard. The amorphous core wrap assists in fire retardation as it is itself a fire resistant material.

Since performing the above tests on samples 'A' to 'D' above, further tests have now been performed under the test method of the new standard test UL 910 by Underwriters Laboratories personnel to determine flame spread and smoke scale characteristics on production samples similar in construction to sample 'D' above.

Two tests, Test No. 1 and Test No. 2 were performed by Underwriters Laboratories. In each of these tests, twenty-eight cable lengths, each with 25 pairs of conductors in its core, were laid side-by-side in a ladder-like cable tray and disposed, on the tray, horizontally within and towards the top of a horizontal fire-test chamber of a Steiner Tunnel apparatus. The chamber was lined with refractory fire brick and along one side had double-pane windows to permit observation of the fire and distance of flame spread. Two gas burners at one end of the chamber delivered flames upwards to engulf the test samples at one location. The gas is metered for heat control and draft into the chamber is also controlled.

As burning proceeded, flame spread along each test sample from the point of application of the burner flame was measured visually through the windows. Also smoke density was measured in the manner described for the previous samples.

The results of these two tests are as follows:

| | Test No. 1 | Test No. 2 |
|---|---|---|
| Maximum Flame Spread | 2.5 feet | 3.0 feet |
| Time To Reach Maximum Flame Spread | 5m 16s | 4m 2.9s |
| Peak Smoke Density | 0.24 | 0.22 |

It should be noted that for a cable to be classified as one suitable for use as a plenum cable by Underwriters Laboratories under UL 910, it must have a maximum flame spread of 5 feet and a peak smoke density of 0.5.

The cable according to the embodiments of the invention is made by manufacturing the core, complete with its interstices filled with powder, and then enclosing the core within the jacket by a conventional jacket extrusion process. The powder may be added to the core in various ways, for instance as described in U.S. Pat. No. 4,100,002 entitled "Method For Producing Powder Filled Cable", granted July 11, 1978 to L. E. Woytiuk, R. Y. Mayer and G. B. Kepes.

What is claimed is:

1. A fire-retardant inside cable consisting essentially of a core, a core wrap material of fire retardant material and a surrounding fluorine based polymer jacket, the core comprising a plurality of insulated electrical conductors in which the insulation is formed from a compound based upon polyvinylchloride, the insulated conductors defining between them interstices which contain a filler consisting essentially of fire resistant hydrated inorganic powder.

2. A fire-retardant inside cable according to claim 1 wherein a core wrap surrounds the core, the core wrap formed from a fire resistant material.

3. A fire-retardant inside cable according to claim 1 wherein the powder is, or contains, alumina trihydrate powder.

4. A fire-retardant inside cable according to claim 2 wherein the core wrap is formed from an aromatic polyamide.

* * * * *

UNITED STATES PATENT AND TRADEMARK OFFICE

CERTIFICATE OF CORRECTION

PATENT NO. : 4,562,302

DATED : December 31, 1985

INVENTOR(S) : John A. Checkland; Leo V. Woytiuk

It is certified that error appears in the above-identified patent and that said Letters Patent is hereby corrected as shown below:

In the cover sheet, column 2, last line, "No Drawings" is revised to read --One Drawing--.

The attached drawing has been added.

UNITED STATES PATENT AND TRADEMARK OFFICE

CERTIFICATE OF CORRECTION

PATENT NO. : 4,562,302 Page 2 of 2

DATED : December 31, 1985

INVENTOR(S) : John A. Checkland; Leo V. Woytiuk

It is certified that error appears in the above-identified patent and that said Letters Patent is hereby corrected as shown below:

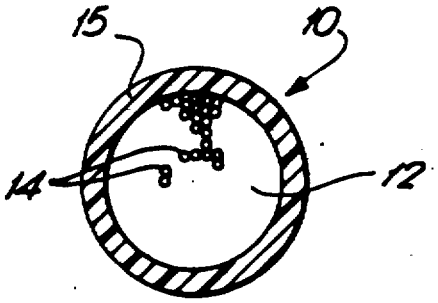

FIG. 1.

Signed and Sealed this

*Twenty-fourth* Day of *June 1986*

[SEAL]

*Attest:*

DONALD J. QUIGG

*Attesting Officer* *Commissioner of Patents and Trademarks*